FIP9606 OR 4,548,594

United States Patent [19]

Lotz

[11] Patent Number: 4,548,594

[45] Date of Patent: Oct. 22, 1985

[54] METHOD AND APPARATUS FOR SEVERING SHEETS OF MATERIAL

[76] Inventor: Walter E. Lotz, 6511 High Ridge Rd., Lantana, Fla. 33462

[21] Appl. No.: 515,513

[22] Filed: Jul. 20, 1983

[51] Int. Cl.[4] ..... B26D 1/56

[52] U.S. Cl. ..... 493/370; 83/98; 83/110; 83/346

[58] Field of Search ..... 83/346, 659, 98, 110; 493/370, 64, 241, 236, 235

[56] References Cited

U.S. PATENT DOCUMENTS

| | | | |
|---|---|---|---|
| 2,033,614 | 3/1936 | Davis et al. . | |
| 2,877,120 | 3/1959 | Bush et al. . | |
| 2,972,452 | 2/1961 | Aumann . | |
| 3,186,274 | 6/1965 | Winkler et al. | 493/370 X |
| 3,318,066 | 5/1967 | Seragnoli . | |
| 3,380,327 | 4/1968 | Stemmler | 493/370 X |
| 4,011,155 | 3/1977 | Feurstein et al. . | |
| 4,054,251 | 10/1977 | Henderson et al. . | |
| 4,275,629 | 6/1981 | McDowell | 83/346 X |
| 4,355,794 | 10/1982 | Costigan . | |
| 4,372,327 | 2/1983 | Dyett et al. | 83/346 X |
| 4,459,172 | 7/1984 | Achelpohl et al. | 83/98 |

*Primary Examiner*—James F. Coan

*Attorney, Agent, or Firm*—Lane & Aitken

[57] ABSTRACT

An interleaver for providing a sheet of paper for each piece of meat moving along a conveyor includes a trap door conveyor section for removing undersized pieces in response to measurements made by photo optical sensors. A knife crushes paper from a paper roll to sever a web of the paper into the sheets. A conveyor pulls the severed sheets from the knife, and air blower guides the web to the knife and prevents the next leading edge of the web from sticking to the knife. Two paper rolls are provided, one roll operating while the other roll stands by. Photo optical sensors monitor the feed from the rolls and switch the feed to the stand by roll if there is an interruption in the feed from the first roll. In addition, both rolls may operate together. A brake is provided for each paper roll, and each paper roll is fixed to a spindle which provides for adjustment of the position of the paper roll axially on the spindle.

12 Claims, 10 Drawing Figures

METHOD AND APPARATUS FOR SEVERING SHEETS OF MATERIAL

BACKGROUND OF THE INVENTION

In the process of packaging pieces of meat and other products, it is desirable to place a sheet of paper or other separating material between adjacent pieces in a package to prevent the pieces from sticking together. Interleaving machines are known which shear sheets of paper from a roll, usually by piercing the paper when it is supported by a resilient surface, and place each sheet in contact with a product to be packaged. However, the paper cutting devices quickly become dull, thus requiring frequent machine shutdowns while the cutting device is sharpened or replaced. In addition, the interleaver machine must also be stopped when the paper roll empties and must be changed, or when there is some other interruption in the supply of paper. Furthermore, in feeding paper from the roll to the cutting device, problems have existed with respect to permitting the paper to unwind freely from the paper roll without producing an excess of slack in the web of paper being fed. Other problems have existed in precisely aligning the sheets of paper with the pieces of meat. It is also desirable to provide a mechanism for controlling the quality of the meat being packaged so that undersized pieces of meat are removed from the interleaver before they are papered and packaged.

SUMMARY OF THE INVENTION

In order to overcome the deficiencies of the prior art, the applicant has devised an interleaver for placing a cut-to-length sheet of paper under a food product, such as a piece of meat, as a series of pieces of meat pass through the interleaver on a conveyor. The meat is received on the conveyor from a source, such as slicing machine, and is measured by photo optical sensors to assure that the meat measures up to a predetermined size. Meat which is deficient in size is eliminated by falling through an opening defined by a trap door conveyor section which is pivotally mounted to swing up out of the plane of the meat conveyor. Meat of sufficient size proceeds to a paper triggering conveyor section, where its presence is detected by a paper triggering photo optical sensor. The paper triggering photo optical sensor triggers the paper conveying assembly for drawing a web of paper from a paper roll rotatably mounted in the interleaver and a knife for separating a sheet of paper of predetermined length from the web. The knife protrudes from a knife drum which rotates so that the knife severs the paper by crushing it against a hard surface of a cooperating anvil drum. Since the blade of the knife crushes the paper against the hard surface, it severs the paper even when the blade is not sharp. Therefore, shutdown of the machine for knife sharpening is eliminated. A conveyor of O-rings pulls the sheet away from the knife and advances it to the meat conveyor to underlie a piece of meat. Guide elements are provided upstream of the knife, and are formed with air passages so that air blows toward the knife to guide the web of paper to the knife and to prevent the next leading edge of the web from sticking to the knife, which tends to happen as a result of the crushing mode of severing.

Two paper rolls are provided so that one may stand by as the other is in operation, so that if the supply of paper from the operating roll is interrupted, paper begins feeding from the standby roll. Photo optical sensors are provided to monitor the feeding of the web of paper from the paper rolls and to automatically switch from one paper roll to the other if the supply of paper from the first paper roll is interrupted. The interleaver can also be operated so that both paper rolls feed together, thereby supplying two sheets of paper for every piece of meat. A brake is provided for each paper roll to permit it to rotate freely when paper is demanded by the paper conveying assembly and to slow when the demand for paper is reduced, thereby avoiding excess slack in the web of paper. Each paper roll is mounted on a spindle which includes a gripping assembly for securely hold the paper roll for rotation with the spindle. The entire gripping assembly is movable axially with respect to the rest of the paper so that the axial position of the paper roll can be adjusted. In this manner, the paper can be aligned precisely with the pieces of meat on the meat conveyor even though the position of the meat pieces on the meat conveyor varies in the transverse direction.

DETAILED DESCRIPTION OF THE PREFERRED EMBODIMENT

Figure 1:
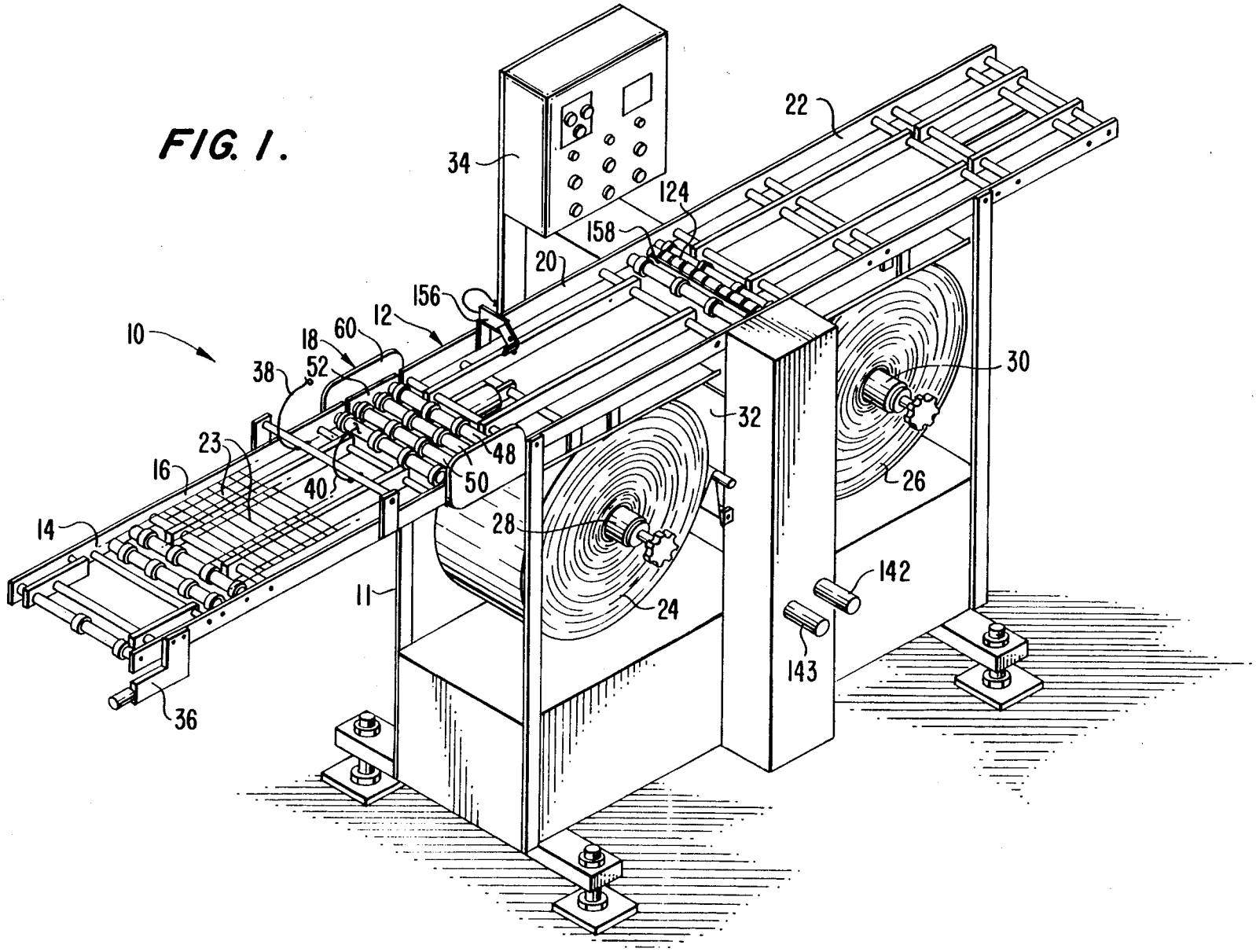
FIG. 1 is a perspective view of the interleaver according to the present invention.

As can be seen best from FIG. 1, the interleaver according to the present invention, which is designated generally by the reference numeral 10, comprises a frame 11 which includes along its top a horizontal conveyor 12 for the meat or other product. The meat conveyor 12 is made up of a plurality of conveyor sections for moving the meat from associated equipment such as a slicer to other equipment such as a stacker and packer. The meat conveyor 12 includes an inlet conveyor section 14 for receiving the meat from the associated equipment, a measuring conveyor section 16 in which the meat is measured to determine its acceptability, a trap door conveyor section 18 which pivots out of the plane of the rest of the meat conveyor 12 to allow unacceptable meat to fall from the meat conveyor 12, a paper triggering conveyor section 20 on which the presence of a piece of meat is detected so that a sheet of paper can be placed under the meat at the end of the paper triggering conveyor section 20, and an outlet conveyor section 22 for moving the meat and sheet of paper to an associated stacking and/or packing machine. Each of the meat conveyor sections may include an endless belt of, for example, open wire mesh, such as the conveyor belt 23 of the measuring conveyor section 16.

The interleaver 10 also includes a pair of paper rolls 24 and 26 mounted for rotation on adjustable spindles 28 and 30, respectively, to supply continuous webs of paper P1 and P2 of indeterminate length. In addition, a paper conveying assembly 32 including a knife 84 (FIG. 5) is provided to move paper from one or both of the paper rolls 24 and 26 to the downstream end of the paper triggering conveyor section 20. A control panel 34 controls the operation of the interleaver 10.

QUALITY CONTROL

Figure 2:
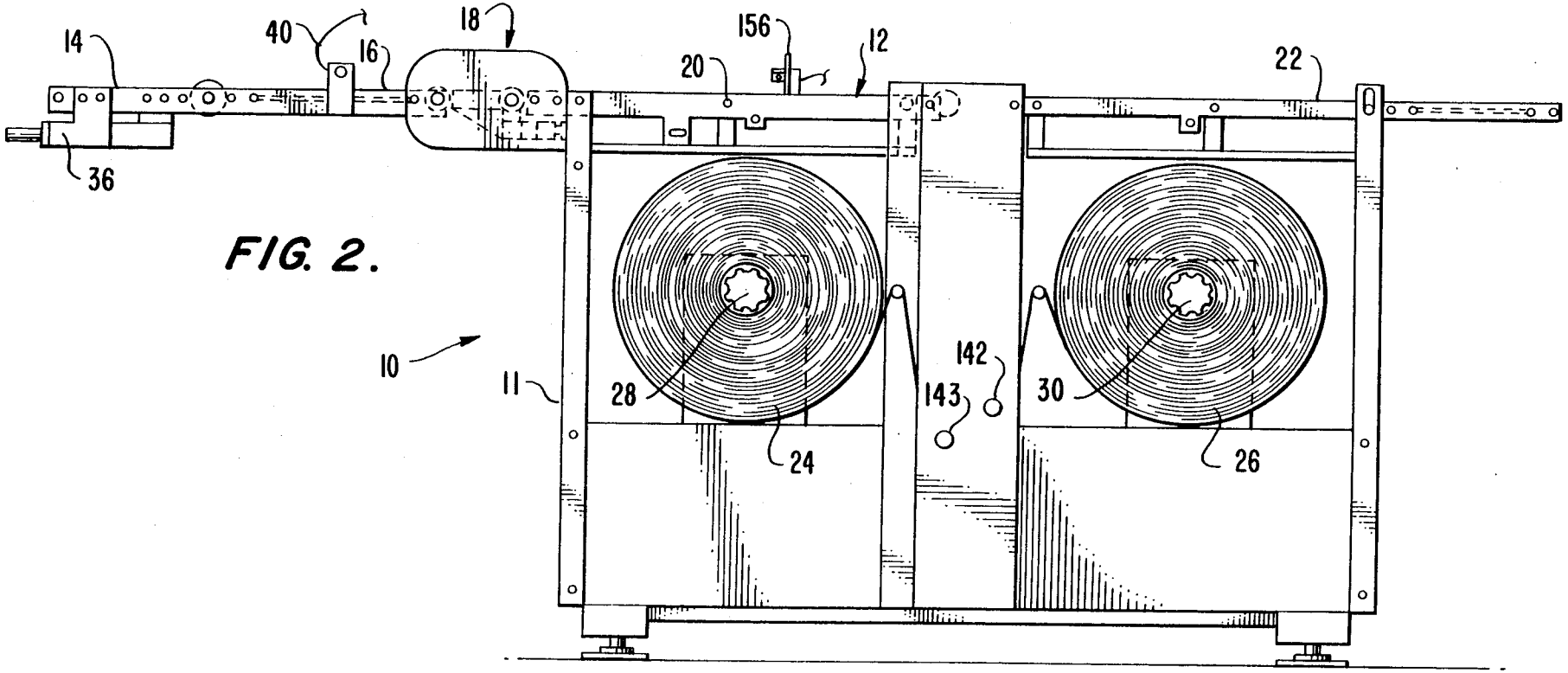
FIG. 2 is a front elevation of the interleaver of FIG. 1, without the control panel.

As can best be seen from FIGS. 1 and 2, a connector element 36 is provided at the inlet end of the inlet conveyor section 14 to connect the interleaver 10 to a slicing machine or other source of supply of meat or other product. The inlet conveyor section 14 moves the meat to the measuring conveyor section 16, over which are mounted fiber optic leads 38 and 40 of quality control photo optical sensors 42 and 44, respectively, (FIG. 4) which are positioned within the interleaver 10. The fiber optic leads 38 and 40 are spaced apart in a direction transverse to the movement of the meat on the measuring conveyor section 16. The fiber optic leads 38 and 40 detect the presence or absence of the meat on the measuring conveyor section 16 at points at which the fiber optic leads 38 and 40 are aimed. The fiber optic leads 38 and 40 are directed to points on the measuring conveyor section 16 which are spaced apart transversely a distance equal to the minimum acceptable width of the piece of meat. Thus, if the meat is sufficiently wide to meet the standards set, both of the fiber optic leads 38 and 40 detect the presence of the meat, and the photo optical sensors 42 and 44 transmit a signal representative of the acceptability of the width of meat. In addition, the fiber optic leads 38 and 40 detect the presence of the piece of meat throughout its length, so that the photo optical sensors 42 and 44 transmit signals whose durations are proportional to the length of the meat. Since the speed of the measuring conveyor section 16 is known, the length of each piece of meat can be measured and the appropriate signal can be transmitted. If the meat meets the minimum requirements for both width and length, it is permitted to move to the interleaving area for placement on one or two pieces of paper. If, however, the meat fails to satisfy either of the width or length standards, the photo optical sensors 42 and 44 transmit a signal for removing the meat from the meat conveyor 12.

Figure 3:
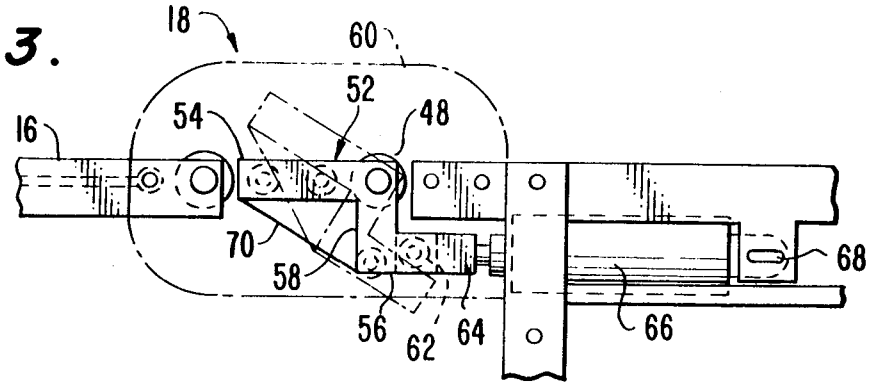
FIG. 3 is an enlarged elevation of the trap door conveying section, with the support plates removed and the tilted position of the trap door conveyor section shown in phantom.

The removal is accomplished by the trap door conveyor section 18, which is positioned downstream of the measuring conveyor section 16. The trap door conveyor section 18 includes a conveyor belt, like the conveyor belt 23 of the measuring conveyor section 16, extending around a drive roller 48, at the downstream end of the trap door conveyor section 18, and a plurality of idler rollers 50, the ends of all of which are mounted for rotation in a pair of spaced parallel link members 52. As can be seen from FIG. 3, each link member 52 has upper and lower parallel portions 54 and 56 offset from one another by a connecting portion 58. The drive roller 48 and the idler rollers 50 extend between the upper parallel portions 54, with the drive roller 48 being positioned at the junctures of the upper parallel portions 54 and the connecting portions 58. The ends of the drive roller 48 extend through the link members 52 into linkage support plates 60 positioned outside the link members 52, and thrust washers are positioned on the ends between the link members 52 and the linkage support plates 60. The linkage support plates 60 are secured to the measuring conveyor section 16 and to the paper triggering conveyor section 20 downstream of the trap door conveyor section 18 for pivotally supporting the trap door section 18. A spacer bar 62 is connected between the lower parallel portions 56, and a fluid cylinder connector member 64 is secured at the center of the spacer bar 62 to connect the trap door conveyor section 18 to the operating rod of a fluid cylinder 66, such as an air cylinder. The fluid cylinder is mounted at its other end by a spacer bar 68 secured to another portion of the interleaver 10.

In operation, when the piece of meat or other product moving on the measuring conveyor section 16 satisfies the size standards set, it continues across the trap door conveyor section 18 to the paper triggering conveyor section 18. However, when the piece of meat falls below the predetermined standards, one or both of the photo optical sensors 42 and 44 send a signal to the fluid cylinder 66, actuating the fluid cylinder to extend the operating rod, thereby pivoting the trap door conveyor section 18 upward about the drive roller 48 in a clockwise direction, as can be seen in phantom in FIG. 3. The actuation of the fluid cylinder 66 can be accomplished by actuating a solenoid valve 69 (FIG. 4) to permit pressurized fluid to flow into the cylinder. With the trap door conveyor section 18 raised, the measuring conveyor section 16 dumps the unacceptable piece of meat into the space between the measuring conveyor section 16 and the paper triggering conveyor section 20. A waste bin is ordinarily provided below the opening for collecting the meat. Since the measuring conveyor section 16 moves at fairly high speeds, it tends to fling the unacceptable meat into the empty space. In order to direct the meat downward and to protect the underside of the trap door conveyor section 18 from a buildup of meat particles and grease, a deflector plate 70 is secured at an angle to the underside of the trap door conveyor section 18, extending across the spaced parallel link members 52 between the upstream ends of the upper parallel portions 54 and the upstream ends of the lower parallel portions 56. Even when the trap door conveyor section 18 is pivoted to its upper position, the deflector plate 70 is angled downwardly to deflect the meat down.

Figure 4:
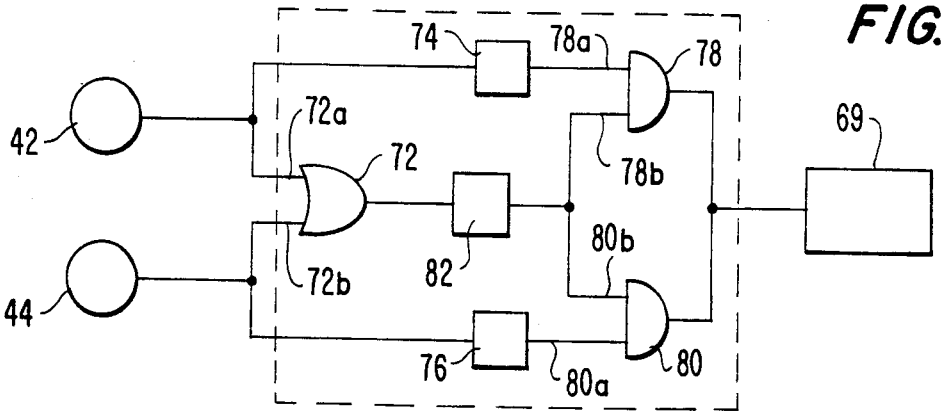
FIG. 4 is a block diagram of a system for controlling the operation of the trap door conveyor section.

FIG. 4 illustrates schematically a system for employing the signals from the quality control photo optical sensors 42 and 44 to operate the fluid cylinder 66 for lifting the trap door conveyor section 18. The output from the photo optical sensor 42 is connected to one input **72*a* of an OR gate 72 and to the input of an inverter 74. The output from the photo optical sensor 44 is connected to the other input 72*b* of the OR gate 72 and to the input of an inverter 76. The output of the inverter 74 is connected to one input 78*a* of an AND gate 78, and the output of the inverter 76 is connected to one input 80*a* of an AND gate 80. The output of the OR gate 72 is connected to the input of a monostable multivibrator 82, commonly called a "one shot", the output of which is connected to the other inputs 78*b* and 80*b* of the AND gates 78 and 80. The outputs of the AND gates 78 and 80 are connected to the solenoid valve 69 or other device which controls the flow of fluid into the fluid cylinder 66**.

Thus, when the meat on the inlet conveyor is sufficiently wide, it will be detected by the fiber optic leads 38 and 40 of both of the photo optical sensors 42 and 44, the fiber optic leads 38 and 40 monitoring positions spaced a predetermined distance transversely with respect to the measuring conveyor section 16. The photo optical sensors 42 and 44 will both send a signal to their respective inputs **72*a* and 72*b* of the OR gate 72, which will therefore produce an output to be received by the "one shot" 82. Thus, the "one shot" 82 will be tripped through the OR gate 72 and will produce an output signal of a predetermined duration. The duration is selected to take into account the speed of the measuring conveyor section 16 and the desired length of the piece of meat. The output of the "one shot" 82 will send an enabling signal to one of the inputs 78*b* and 80*b* of each of the AND gates 78 and 80 for the predetermined period. However, the signals from the photo optical sensors 42 and 44 will result in no output from either of the inverters 74 and 76 and, thus, no enabling signal at either of the other inputs 78*a* or 80*a* of the AND gates 78 and 80. Thus, no signal will be sent by either of the AND gates 78 or 80 to the solenoid valve 69. Therefore, the fluid cylinder 66 will not be actuated and the trap door conveyor section 18 will not be moved. This is appropriate since a piece of meat which is sensed by both of the photo optical sensors 42 and 44 is sufficiently wide and should not be removed at the trap door conveyor section 16. If, however, the piece of meat is not wide enough, it will not be detected by one of the photo optical sensors 42 or 44, for example, the photo optical sensor 42. When this occurs, no signal is sent to the inverter 74, which results in an enabling signal from the inverter 74 to the input 78*a* of the AND gate 78. In addition, the detection of the leading edge of the piece of meat on the other side by the photo optical sensor 44 causes the OR gate 72 to trigger the "one shot" 82 to send an enabling signal to the other input 78*b* of the AND gate 78, thereby resulting in an output from the AND gate 78 to the solenoid valve 69. Therefore, the fluid cylinder 66 is actuated, pivoting the trap door conveyor section 18** upward and allowing the unacceptable piece of meat to fall into the collection bin.

If the piece of meat is too short, or if a notch is formed in the side of the piece, for example along the side detected by the photo optical sensor 44, no signal will be sent to the inverter 76 when the rear end of the meat or the notch passes through the position detected by the fiber optic lead 40. As a result, no input will be sent to the inverter 76, thereby resulting in an enabling signal from the inverter 76 to the input **80*a* of the AND gate 80. At the same time, an enabling signal exists at the other input 80*b* of the AND gate 80 due to the signal of predetermined duration from the "one shot" 82 as the result of the detection of the leading edge of the piece of meat from either of the photo optical sensors 42 or 44. Thus, the AND gate 80 will have an output which operates the solenoid valve 69, thereby actuating the fluid cylinder 66, pivoting the trap door conveyor section 16** upward and removing the unacceptable piece of meat.

PAPER CONVEYING ASSEMBLY AND KNIFE

Most pieces of meat are advanced to the paper triggering conveyor section 20, which moves the pieces to a point in the meat conveyor 12 where they are brought into contact with sheets of paper. The system for providing the sheets of paper will now be described in connection with FIG. 5.

The pair of paper rolls 24 and 26 are mounted adjacent to a paper conveying assembly 32 which pulls the paper from one or both of the paper rolls 24 and 26 and moves it past a knife 84 to the point in the meat conveyor 12 where it is brought into contact with the meat. The paper roll 24 for one side of the paper conveying assembly 32 will be described, as can be seen from FIG. 5, but it is understood that the description could also be applied to the paper roll 26. The paper roll 24 is mounted for rotation on the spindle 28 (FIGS. 1 and 2) which is connected at one end to the frame 11 of the interleaver 10 for supporting the paper roll 24 in a cantilevered manner. A take up roller 86 is resiliently mounted between the paper roll 24 and the rest of the paper feed assembly 32 to eliminate any slack from the continuous web of paper being fed. The web continues from the take up roller 86 and passes horizontally under an outer guide bar 88 to top and bottom paper conveying rollers 90 and 92 which comprise a lower pair of paper conveying rollers which clamp the web between them and pull it along. The web is fed around an inner guide bar 94 and moved to an upper pair of paper conveying rollers 96 and 98 which are in horizontal alignment to clamp the web therebetween and advance it upwardly.

Figure 5:
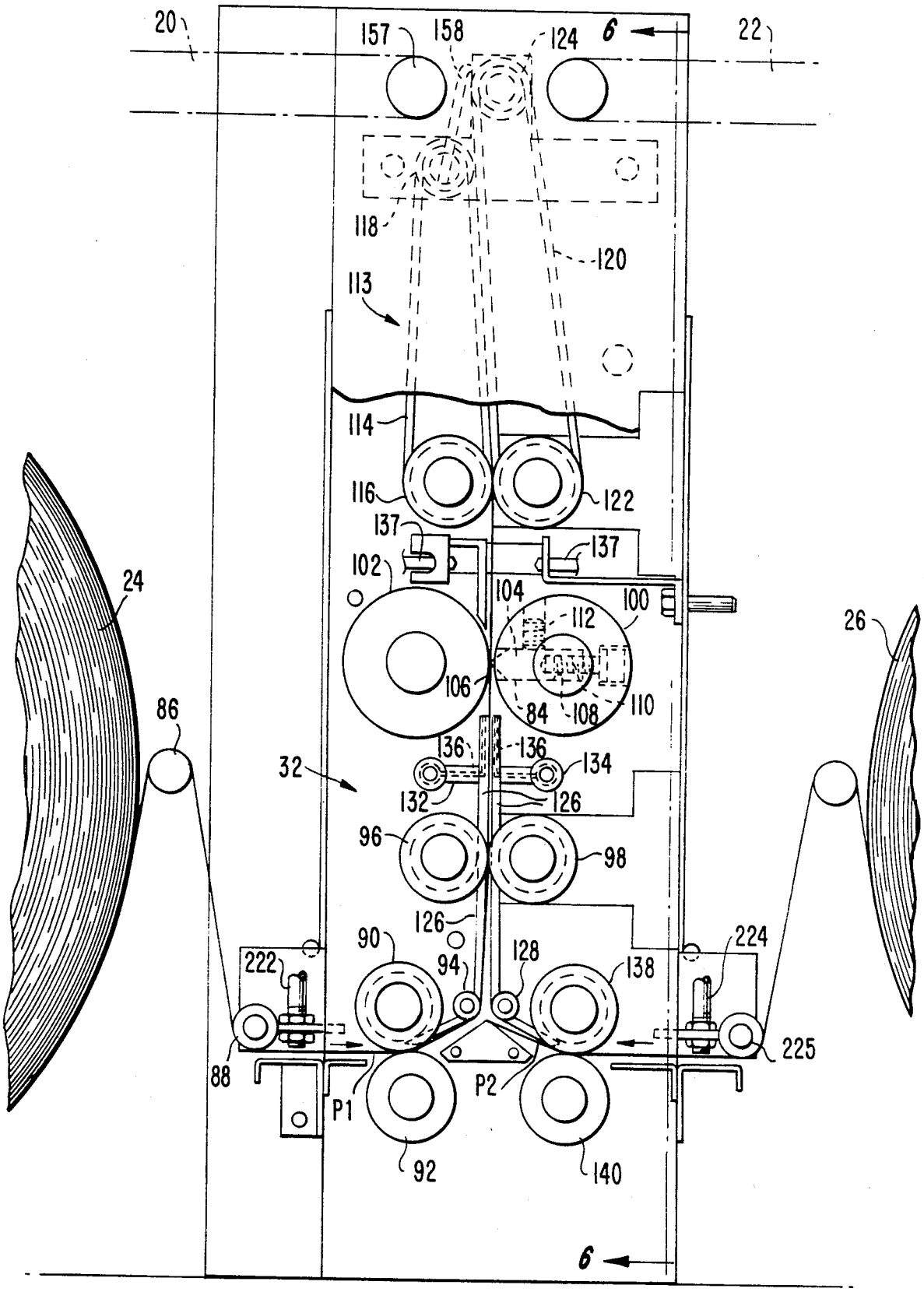
FIG. 5 is an enlargement of the paper conveying assembly of the interleaver of FIG. 2, with the front panel of the housing removed.

The knife 84 for cutting a sheet of paper of predetermined length from the web is mounted horizontally in a horizontal knife drum 100 from which it protrudes for crushing the web of paper along a horizontal line to cause separation of the sheet from the web. The knife 84 cooperates with a hard surfaced anvil drum 102 of a hard material, such as stainless steel, which is mounted parallel and adjacent to the knife drum 100 so that the protruding knife 84 engages the anvil drum 102 when the knife 84 is horizontal and facing the anvil drum. The web of paper passes between the anvil drum 102 and the knife drum 100, and the drums rotate together, so that upon each rotation a sheet of paper of predetermined length is separated from the web. The knife 84 has a thick elongated body 104 having a protruding crushing edge 106 which defines in cross section an angle of about 90° or somewhat less than 90°. Although the crushing edge 106 may be sharp to begin with, sharpness is not required since the crushing edge 106 severs the paper by crushing the paper along a line against the anvil drum 102. The relatively wide angle defined by the crushing edge 106 in cross section provides a large mass of material at the edge, so that the material does not wear down. The crushing edge 106 maintains its shape and continues to sever the paper by crushing it against the hard surface of the anvil drum 102. Therefore, the interleaver 10 can operate without shutdowns for knife sharpening or replacement. The knife 84 is positioned in a cavity 108 extending axially along the knife drum 100 and radially from the surface of the knife drum into the center of the knife drum. Set screws 110 are positioned below the body of the knife 84 for adjusting the amount of protrusion of the knife 84 beyond the surface of the knife drum 100. Other set screws 112 engage a side of the body 104 to hold the knife 84 secure in the cavity 108. The knife 84 is shown in FIG. 5, in its paper severing position. In its rest position, the knife 84 is positioned 180° from the position shown.

When the position of the knife 84 in the knife drum 84 is properly adjusted, it severs the paper reliably. Even if the alignment and amount of protrusion of the knife 84 lose their proper adjustment over a period of time, the paper is severed because the knife 84 works in connection with a paper transporting device in the form of an O-ring paper conveyor 113 which is mounted above the knife 84 to pull the sheet away from the web. The O-ring conveyor 113 includes a plurality of short O-rings 114 stretched around a lower short O-ring roller 116 and an upper short O-ring roller 118, and a plurality of long O-rings 120 stretched around a lower long O-ring roller 122 and an upper long 0ring roller 124. Each of the O-ring rollers includes a plurality of axially spaced circumferential grooves 125 (FIG. 6) corresponding to the number of O-rings to receive and guide the O-rings. The various O-ring rollers are positioned so that the adjacent runs of the short and long O-rings engage one another for gripping the paper sheets therebetween and moving the paper sheets toward the meat conveyor 12.

In addition to the paper conveying assembly structure already described, a plurality of elongated spaced parallel guide elements 126 in the form of thin rods or wires extend vertically upward from the inner guide bar 94 and a matching inner guide bar 128 for the web of paper from the paper roll 26 to a point just below the line of contact of the knife 84 with the anvil drum 102. The guide elements 126 guide and support the web of paper in a vertical orientation between the inner guide bar 94 and the upper paper conveying rollers 96 and 98, as well as between the upper paper conveying rollers 96 and 98 and the knife 84. As can be seen better from FIG. 6, the upper conveying rollers 96 and 98 include circumferential grooves 130 which receive the guide elements 126, thereby also permitting the upper paper conveying rollers 96 and 98 to pinch the web of paper therebetween. The guide elements 126 are also supported by connecting rods 132 which are connected between each of the guide elements 126 and one of a pair of horizontal manifold tubes 134 positioned at a level between the upper conveying rollers 96 and 98 and the knife and anvil drums 100 and 102. The connecting rods 132, the upper portions of the guide elements 126 and the walls of the manifold tubes 134 are drilled to define air passages 136 for compressed air from a compressed air source (not shown) which is connected to the manifold tubes 134. The compressed air blows upwardly from the upper ends of the guide elements 126 to guide the web of paper into position for severing by the knife 84. The air also prevents the next leading edge of the web of paper from sticking to the knife 84 after a sheet has been severed. Four additional air passages for blowing air on the paper are defined in tubes 137 (two of which are shown) positioned in pairs above the knife drum 100 and above the anvil drum 102, the tubes 137 in each pair being spaced apart in a manner similar to the spacing between the grooves 130 of the paper conveying roller 98, with the tubes 137 of opposite pairs being directed toward one another.

When a new paper roll, for example, paper roll 26, is installed in the interleaver 10 and the paper conveying assembly 32 is not operating, the leading edge of the web P2 from the new paper roll 26 must be threaded between top and bottom paper conveying rollers 138 and 140, which comprise a lower pair of paper conveying rollers similar to the top and bottom paper conveying rollers 90 and 92 for the web P1 from the paper roll 24. To accomplish this, a thread up handle 142 is connected to the shaft 144 of the top lower paper conveying roller 138 for manual rotation of the lower paper conveying rollers 138 and 140. As can best be seen from FIG. 6, the thread up handle 142 is mounted on an end of the shaft 144 which protrudes forwardly from a front wall 146 of a cabinet enclosing a drive system for the paper conveying assembly 32. The thread up handle 142 is biased forwardly by an internal spring 148 out of engagement with a post 150 extending radially from the shaft 144. A slot 152 is provided in the end of the thread up handle 142 in alignment with the post 150. In its rest position, the handle 142 is biased out of engagement with the post 150 and into engagement with a post 153 mounted in the front wall 146 for engaging an aperture 154 in a flange 155 on the thread up handle 142, thereby preventing the handle 142 from rotating with the shaft 144 as the result of frictional forces. Under manual pressure, however, the handle 142 can be forced inwardly so that the post 150 is captured in the slot 152. Rotation of the handle 142 in this position causes rotation of the lower paper conveying rollers 138 and 140 and permits the web P2 of paper to be threaded. A similar thread up handle 143 is provided on a shaft of the bottom lower paper conveying roller 92 for threading the web P1. An electrically operated brake 244 is mounted around the shaft 144 and a like brake 246 is mounted around the equivalent shaft associated with the web P1 in order to keep each shaft from rotating when the opposite shaft is in operation, as will be described further in connection with FIG. 8.

The web of paper from the operating paper roll, in this case the web P1 from the paper roll 24, is advanced to a point about ¼" below the bottom point of engagement between the paper conveying O-rings 114 and 120. The knife 84, which is facing away from the web, is actuated to rotate to sever the paper when a piece of meat reaches an appropriate position on the paper triggering conveyor section 20. When this occurs, the paper web moves into engagement with the paper conveying O-rings 114 and 120, and the knife drum 100 makes one revolution, severing a sheet of paper from the web so that the paper conveying O-rings 114 and 120 pull the severed sheet away from the web and advance the sheet to the meat conveyor 12, underlying the piece of meat. In order to pull the severed sheet away from the web, the paper conveying O-rings 114 and 120 travel at a higher speed than the paper conveying rollers 96 and 98. However, if a significant retarding force is applied to the paper engaged by the paper conveying O-rings 114 and 120, the paper slips with respect to the O-rings. In this manner, the higher speed paper conveying O-rings 114 and 120 will not tear the paper before the knife 84 can sever the paper. As one sheet of paper is severed and advanced to the meat conveyor 12, the new leading edge of the web moves to the point about ¼" below the O-rings 114 and 120 and stops until the next piece of meat reaches the appropriate position on the paper triggering conveyor section 20. At this time, the web moves up and the knife 84 is triggered to begin the next severing operation.

The triggering is accomplished by a fiber optic lead 156 of a paper triggering photo optical sensor, which is positioned over the paper triggering conveyor section 20. When a piece of meat on the paper triggering conveyor section 20 reaches the point monitored by the fiber optic lead 156, the paper triggering photo optical sensor sends a signal to the drive for the paper conveying assembly 32 to advance the web of paper (as will be described further hereinafter), to cut a sheet of predetermined length and to feed it to the downstream end of the paper triggering conveyor section 20, which moves the piece of meat onto the sheet of paper. In order to advance the sheets of paper into a position to underlie the pieces of meat, the upper long O-ring roller 124 is mounted adjacent a drive sprocket 157 at the downstream end of the paper triggering conveyor section 20 in the same horizontal plane as the drive sprocket, as can best be seen from FIG. 5. The upper short O-ring roller 118 is mounted below the drive sprocket 157, and a sheet guide 158 which curves slightly toward the downstream direction of the meat conveyor 12 is interposed between the drive sprocket 157 and the upper long O-ring roller 124, terminating at about the level of the top surface of the meat conveyor 12. The sheets of paper pass between the sheet guide 158 and the upper long O-ring roller 124, thereby insuring that the sheet guide 158 directs the paper sheets downstream. The leading edge of the piece of meat arrives at the top of the sheet guide 158 just after the leading edge of the sheet arrives, thereby assuring that the sheet will underlie the piece of meat as the piece of meat and the sheet are moved onto the outlet conveyor section 22 just downstream of the upper long O-ring roller 124. The outlet conveyor section 22 moves the piece of meat on the sheet of paper to a stacking and/or packaging machine to which the interleaver 10 can be connected.

Figure 6:
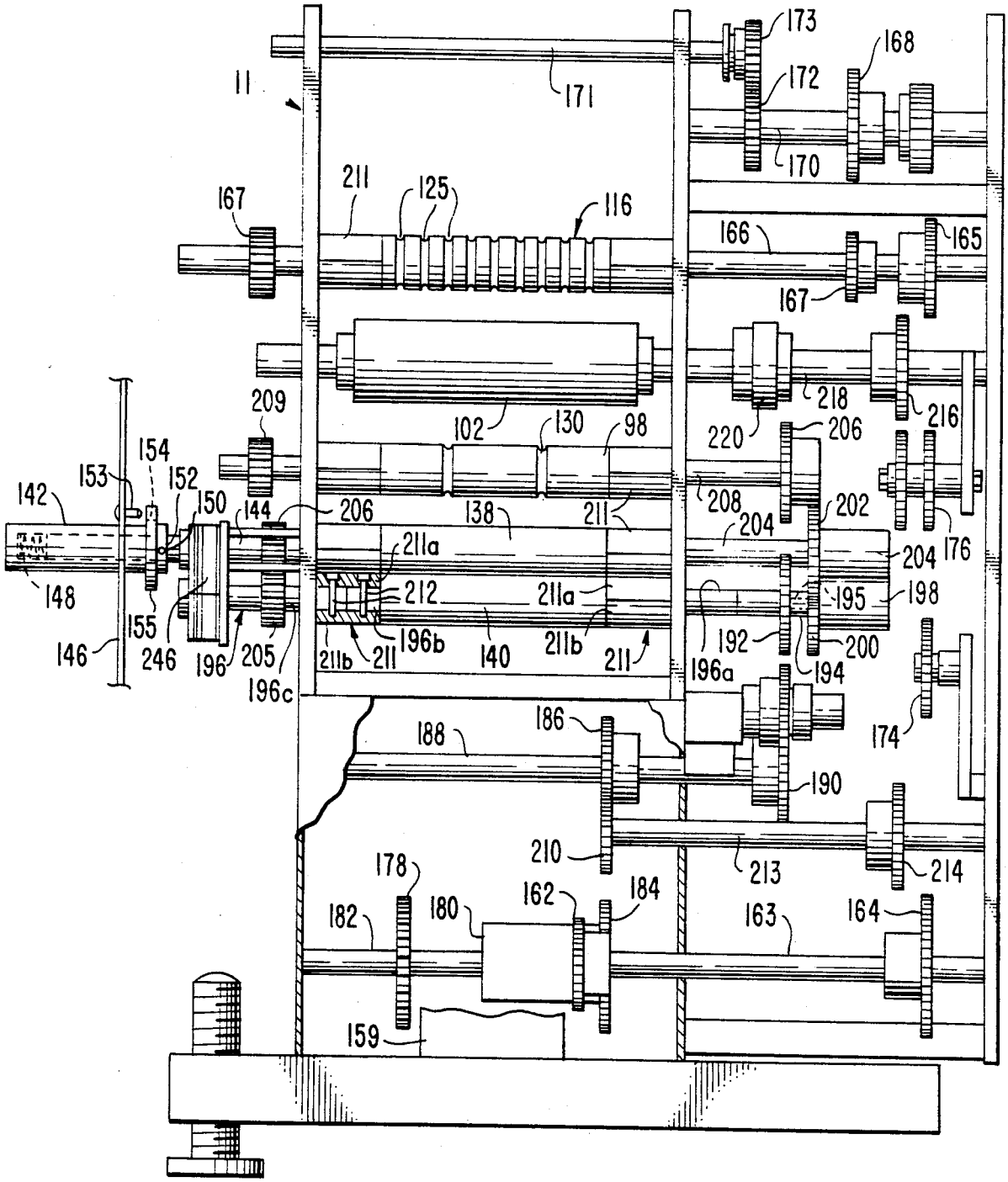
FIG. 6 is a view taken along the line 6—6 in FIG. 5, and showing a driving arrangement not shown in FIG. 5.
Figure 7:
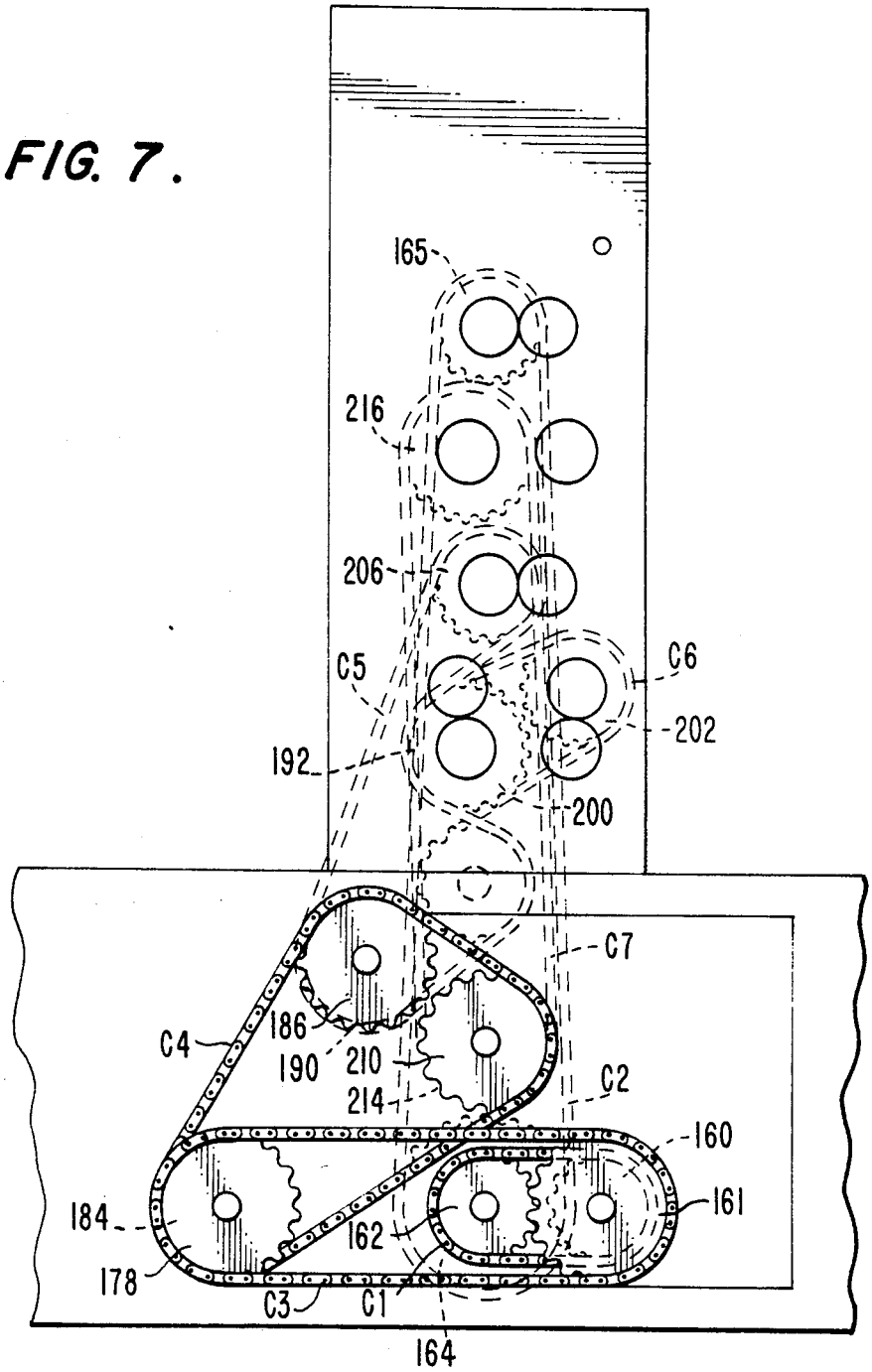
FIG. 7 is a schematic illustration from the side of the sprockets and drive chains of the driving arrangement of FIG. 6.

The drive mechanism for the interleaver can best be seen from FIGS. 6 and 7. An electric motor (not shown) is connected to a gear box 159 which has a first output sprocket 160 at one end and a second output sprocket 161 at the opposite end. The gear box 159 is shown broken away in FIG. 6 and the first and second output sprockets 160 and 161 are not shown in FIG. 6 so that the sprockets and shafts which lie behind them in that view can be seen. In FIG. 7, the gear box 159 would lie in front of the sprocket 160 and behind the sprocket 161. The first output sprocket 160 is connected to an input sprocket 162 on a constant speed output shaft 163 by a drive chain C1. An output sprocket 164 is mounted on the constant speed output shaft 163 for connection by a drive chain C2 to the lower short O-ring roller 116 through its sprocket 165 and shaft 166. A gear 167 is mounted at one end of the shaft 166 for driving connection to a like gear mounted on the shaft of the lower long O-ring roller 122, which has been removed from FIG. 6 since it would be directly in front of the lower short O-ring roller 116. The short O-ring roller shaft 166 includes a second sprocket 167, which is connected by a drive chain (not shown) to a sprocket 168 on a main conveyor drive shaft 170, which in turn drives the drive shafts, such as the drive shaft 171, for moving the belts of the various conveyor sections. The connection between the main conveyor drive shaft 170 and the drive shaft 171 is made through a gear 172 mounted on the main conveyor drive shaft 170 and a gear 173 mounted on the drive shaft 171. The main conveyor drive shaft 170 is positioned slightly below and midway between the drive shaft 171 and a like drive shaft associated with the adjacent meat conveyor section so that the gear 172 can mesh simultaneously with the gear 173 and a like gear mounted on the like drive shaft. Sprockets 174 and 176 are idler sprockets for guiding the chain C2 which connects the sprocket 164 of the constant speed output shaft 163 and the sprocket 165 of the lower long O-ring roller 166. Thus, the O-ring conveyor 113 and the meat conveyor 12 run continuously whenever the interleaver 10 is turned on. The drive chains have been omitted from FIG. 6 for clarity of illustration. It can be seen, however, that sprockets which lie in common vertical planes are connected to one another by drive chains. It is also understood that all the necessary bearings or bushings for mounting the various shafts in the frame 11 are provided.

In contrast to the O-ring conveyor 113 and the meat conveyor 12, the paper conveying rollers 90, 92, 96 and 98 rotate for only a predetermined number of rotations, and the knife drum 100 rotates through one revolution, each time a piece of meat moves into the appropriate position on the paper triggering conveyor section 20. To accomplish the intermittent movement of the paper conveying rollers 90, 92, 96 and 98 and of the knife drum 100, the second output sprocket 161 is connected by a drive chain C3 to an input sprocket 178 of a main clutch 180 mounted on a clutch shaft 182, all of which are positioned behind the constant speed output shaft 163 and the sprocket 162 in FIG. 6 and are partially obscured thereby. The main clutch 180 is an electromagnetically actuated wrapped-spring type of clutch which, when actuated, rotates the clutch shaft 182 one complete revolution and then disengages. The actuation of the main clutch 180 is in response to a signal sent by the paper triggering photo optical sensor that a piece of meat is in the appropriate position on the paper triggering conveyor section 20 for a sheet of paper of predetermined length to be sent to the meat conveyor 12. The fiber optic lead 156 (FIGS. 1 and 2) of the paper triggering photo optical sensor is aimed at the appropriate position on the paper triggering conveyor section 20. In order to feed paper from one of the paper rolls 24 or 26, the main clutch shaft 182 includes an output sprocket 184 which rotates one revolution with the main clutch 180. The output sprocket 184 is connected by a drive chain C4 to an input sprocket 186 on a first paper drive idler shaft 188, which has a changeable output sprocket 190. The changeable output sprocket 190, which lies directly behind the input sprocket 186 in FIGS. 7, is connected by a drive chain C5 to an input sprocket 192 which includes a sleeve 194 freely rotatable on a shaft 195 carrying the bottom lower paper conveying roller 92. It should be noted that much of the shaft 195 is hidden in FIG. 6 by a shaft 196 carrying the bottom lower paper conveying roller 140.

The sleeve 194 is connected to the input of an electromagnetically operated paper feed clutch 198, for example, of the Warner type, mounted on the shaft 195. The output of the paper feed clutch 198 is connected to the shaft 195 and to an output sprocket 200, which is freely rotatable on the sleeve 194. Thus, if the clutch 198 is not actuated, the input sprocket 192 and the sleeve 194 rotate freely without affecting the shaft 195 or the output sprocket 200. However, if the clutch 198 is actuated, the shaft 195 turns with the input sprocket 192, thereby rotating the bottom lower feed 92. Thus, it can be seen that the paper conveying rollers 90, 92, 96 and 98 move the web of paper P1 a predetermined distance upon each actuation of the main clutch 180. Furthermore, by replacing the changeable sprocket 190 with a larger or smaller sprocket, the predetermined length of paper can be increased or decreased, respectively. A gear (not shown) is connected to the end of the shaft 195 carrying the sprockets 192 and 200 to mesh with a similar gear on the shaft carrying the top lower paper conveying roller 90, in an arrangement like that associated with the rollers 138 and 140, which is to be described hereinafter.

The output sprocket 200, which is mounted directly behind the input sprocket 192 in FIG. 7, moves with the input sprocket 192, when the paper feed clutch 198 is actuated, to provide a drive connection through a drive chain C6 to an input sprocket 202 of the shaft 144 carrying the top lower feed roller 183. A gear 205 is mounted on an end of the shaft 196 for meshing with a gear 206 mounted on the shaft 144, so that the rollers 138 and 140 rotate in opposite directions. A gear 209 is mounted adjacent one end of the shaft 208 to mesh with and drive a like gear mounted on a like shaft which carries the paper conveying roller 96.

The shaft 196 includes a plurality of sections including a shaft section **196*a* which is driven by the output of the paper feed clutch 198, a shaft section 196*b* which lies within the bottom lower feed roller 140, and a shaft section 196*c* which extends through a front portion of the frame 11. The shaft sections are connected to one another by split couplings 211, one of which is shown in cross section. Each split coupling 211 includes an upper half 211*a* and a lower half 211*b*, which are held together by bolts 212 extending through aligned openings in the upper and lower halves 211*a*** and *b* and in the sections of the shaft. The split couplings 211 permit the bottom lower feed roller 140 to be removed and replaced without removing any shaft bearings or drive chains, and without pulling a shaft axially through the frame 11. The split couplings 211 are also used in connection with other rollers, such as the paper conveying rollers 96 and 98, and the lower short and long O-ring rollers 116 and 122.

The output sprocket 184 on the clutch shaft 182 is also connected by the drive chain C4 to an input sprocket 210 on a knife drive idler shaft 213. The knife drive idler shaft 213 has an output sprocket 214, directly behind the input sprocket 210 in FIG. 7, which is connected by a drive chain C7 to an input sprocket 216 on an anvil drive shaft 218 which carries the anvil drum 102. The anvil drive shaft 218 has an output gear 220 meshing with an input gear (not shown) on a knife drive shaft carrying the knife drum 100, so that the anvil drum 102 and the knife drum 100 rotate in opposite directions at the same speed. The knife drum 100, if shown in FIG. 6, would be positioned directly in front of the anvil drum 102. Since the knife drum 100 and the paper conveying rollers 96 and 98 are driven through drive chains by the same drive sprocket, i.e., the output sprocket 184 on the clutch shaft 182, the cutting operation of the knife 84 is coordinated with the movement of the web of paper, so that a sheet of paper of predetermined length is cut for each piece of meat.

The paper cutting operation continues until, for example, the source of meat runs out. Interruption of the flow of paper from one paper roll due to the depletion of the supply of paper on the paper roll does not require shutdown of the interleaver 10. While paper is being fed to the paper conveying assembly from one of the paper rolls, for example, the paper roll 24, the leading edge of the paper web from the paper roll 26 is fed manually, by use of the thread up handle 142, through the lower paper conveying rollers 138 and 140 to the point adjacent the inner guide bar 128 where the paper turns vertically upward. Then, the paper web from the paper roll 26 is ready to be moved through the paper conveying assembly 32 if the paper from the paper roll 24 runs out or is otherwise interrupted.

The flow of paper from each of the paper rolls 24 and 26 is detected by optical sensors having fiber optic leads 222 and 224 terminating adjacent the outer guide bars 88 and 225 and directed onto the paper passing by. When the optical sensor for the paper roll being fed, in this example, the paper roll 24, detects the absence of the paper from adjacent to the fiber optic lead 222, it sends a signal to the paper feed clutch 198 for the paper roll 26 to begin feeding paper through the paper conveying assembly 32. Thus, if the flow of paper from the paper roll 24 is interrupted, the paper roll 26 will begin to feed, and vice versa. Furthermore, the interleaver can be set so that both paper rolls 24 and 26 feed simultaneously, in Which case two sheets of paper of predetermined length will be inserted under each piece of meat or other article. Two sheets are advantageous where the meat or other product is quite sticky and the adherence of the product to both sides of a single sheet of paper would still cause difficulty in separating the product.

PAPER ROLL DRIVE CONTROL CIRCUIT

Figure 8:
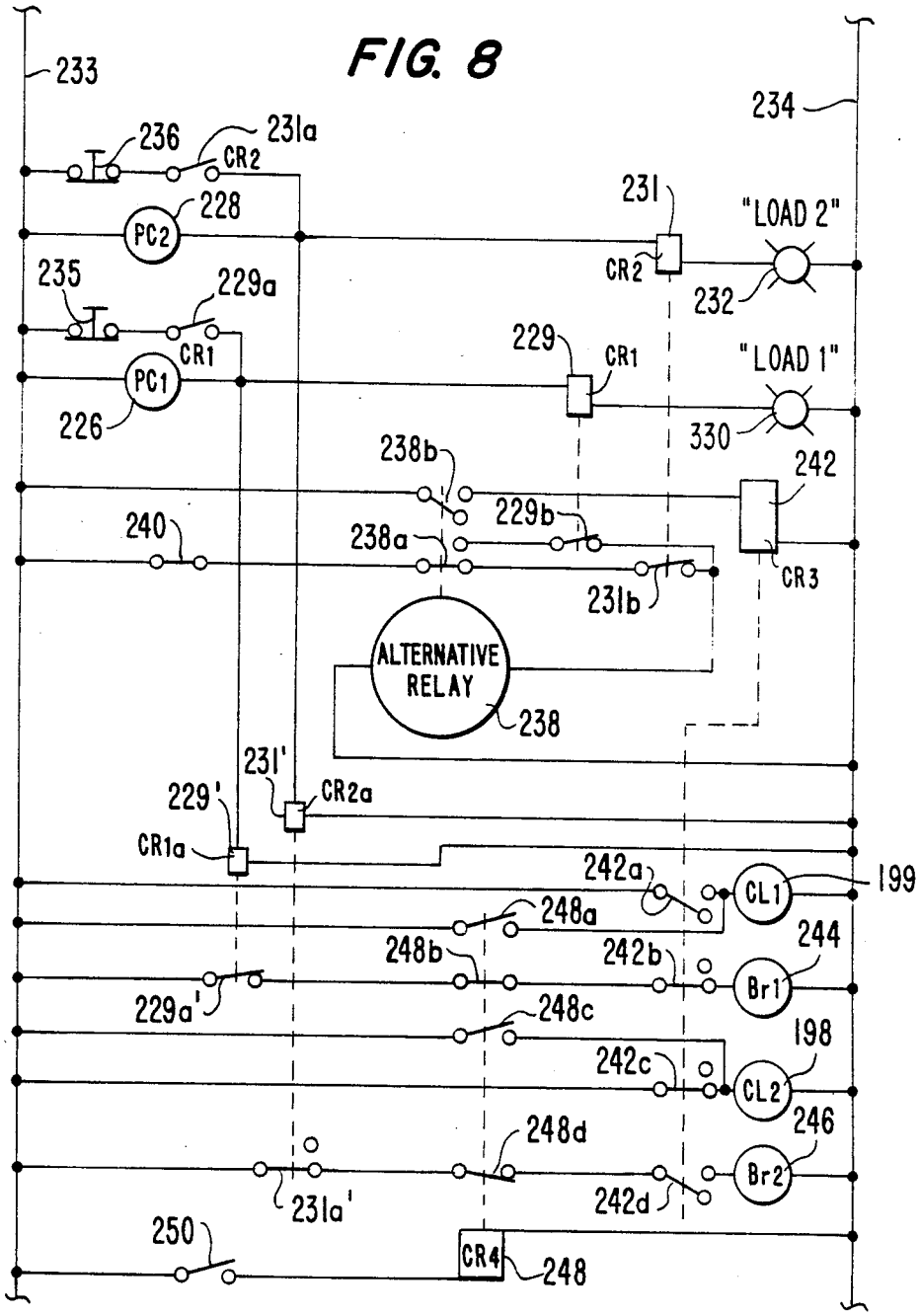
FIG. 8 is a circuit for controlling the operation of the paper feed rolls.

FIG. 8 depicts a circuit for controlling the operation of the lower paper feed rollers 90, 92, 138 and 140 in accordance with the outputs of the web detecting photo optical sensors 226 and 228 in response to the presence of the webs P1 and P2 of paper upstream of the inlets to the lower paper feed rollers 90, 92, 138 and 140. The photo optical sensor 226 is connected in series with a relay 229 and a lamp 230, and the photo optical sensor 228 is connected in series with a relay 231 and a lamp 232 across power conductors 233 and 234. A normally closed, spring biased switch 235 and a contact **229*a* operated by the relay 229 are connected in parallel with the photo optical sensor 226 and in series with the relay 229 and the lamp 230. Similarly, a normally closed, spring biased switch 236 and a contact 231*a* operated by the relay 231 are connected in parallel with the photo optical sensor 228 and in series with the relay 231 and the lamp 232. In addition, a relay 229' is connected to the switch 229*a*, and a relay 231' is connected to the switch 231*a*. An alternating relay 238 is connected in parallel with the elements already mentioned, and in series with a closed, spring loaded switch 240 and a contact 238*a* operated by the alternating relay 238. The alternating relay 238 is further in series with a contact 229*b* operated by the relay 229 and a contact 231*b* operated by the relay 231, the contacts 229*b* and 231*b* being in parallel with one another. The alternating relay 238 also operates a contact 238*b*, which is in series with a relay 242. When the contact 238*a* is closed, the contact 238*b* is open, and vice versa. The electromagnetic clutches 198 and 199 for driving the lower paper feed rollers 140 and 92, respectively, are connected in parallel across the power conductors 233 and 234. Electrically operated brakes 244 and 246, which are mounted on the spindles 28 and 30, respectively, supporting the paper rolls 24 and 26, are connected in parallel with the electromagnetic clutches 198 and 199 and with each other. The relay 242 has contacts 242*a*, 242*b*, 242*c* and 242*d* connected in series with the clutch 199, the brake 244, the clutch 198 and the brake 246, respectively. A relay 248 connected in series with a normally open switch 250 has contacts 248*b* and 248*d* connected in series with the electrically operated brakes 244 and 246, respectively. Note that the brakes 244 and 246 are independent of the paper roll brakes 264 to be described hereinafter. The relay 248 also has contacts 248***a* and 248*c* which are connected in series with the electromagnetic clutches 199 and 198, respectively, and in parallel with the contacts 242*a* and 242*c* of the relay 242. The relay 229' has a contact 229*a'* in series with the electric brake 244, and the relay 231' has a contact 231*a'* in series with the electric brake 246.

In operation, the current flows through the closed, spring loaded switch 240 into the alternating relay 238. Each time the switch 240 is activated, the alternating relay 238 transfers its contacts 238*a* and 238*b*. In the position shown, the contact 238*a* is closed and the contact 238*b* is open. The relay 242 is de-energized, so that the electrically operated brake 244, which is associated with paper web P1 is energized, as is the electromagnetic clutch 198, which is associated with the paper web P2. Thus, the paper web P2 is in operation. The paper webs P1 and P2 are both detected by the photo optical sensors 226 and 228, so that there is no current flow through them. If the paper web P2 breaks or if the flow of the paper web P2 is otherwise interrupted, the photo optical sensor 228 detects the interruption and causes current to flow to the relays 231 and 231' and the lamp 232. The lamp 232 illuminates the legend "LOAD 2", indicating that the flow of paper web P2 has been interrupted, usually as the result of the paper roll 26 being exhausted. The lamp 230 illuminates the legend "LOAD 1" if the flow of paper in the web P1 is similarly interrupted.

The relay 231 closes the contact 231*a*, thereby assuring current through the relay 231 independent of the photo optical sensor 228. The relay 231 also opens the contact 231*b*, thereby activating the alternating relay 238, which switches the position of the contacts 238*a* and 238*b*. Thus, the relay 242 is energized to change the positions of the contacts 242*a–d*. Therefore, the electromagnetic clutch 199 for the paper web P1 is actuated, and the electrically operated brake 244 for the paper web P1 is disengaged, so that the paper web P1 is fed to the knife 84. At the same time, the electromagnetic clutch 198 for the paper web P2 is disengaged, but the brake 246 is not energized, despite the closing of the contact 242*d*, since the closing of the contact 231*a* let current flow to the relay 231', thereby opening the contact 231*a'*. Thus, in this condition, the bottom lower feed roller 140 for the paper web P2 is free-wheeling and may be rotated by the thread up handle 142 to move the web P2 into a standby position in which the photo optical sensor 228 detects the presence of the web and stops the flow of current. When the operator then pushes the normally closed, spring biased switch 236, the relay 231' is de-energized and the contact 231*a'* closes, thus, engaging the brake 246 for the paper web P2. When the supply of paper in the paper web P1 is exhausted, a similar transfer to paper web P2 will take place. If it is desired to operate both webs of paper P1 and P2 at once, the switch 250 is closed to actuate the relay 248. The 25 relay 248 changes the positions of the contacts 248*a–d* to deenergize both electrically operated brakes 244 and 246 and to energize both electromagnetic clutches 198 and 199.

PAPER ROLL BRAKE

Figure 9:
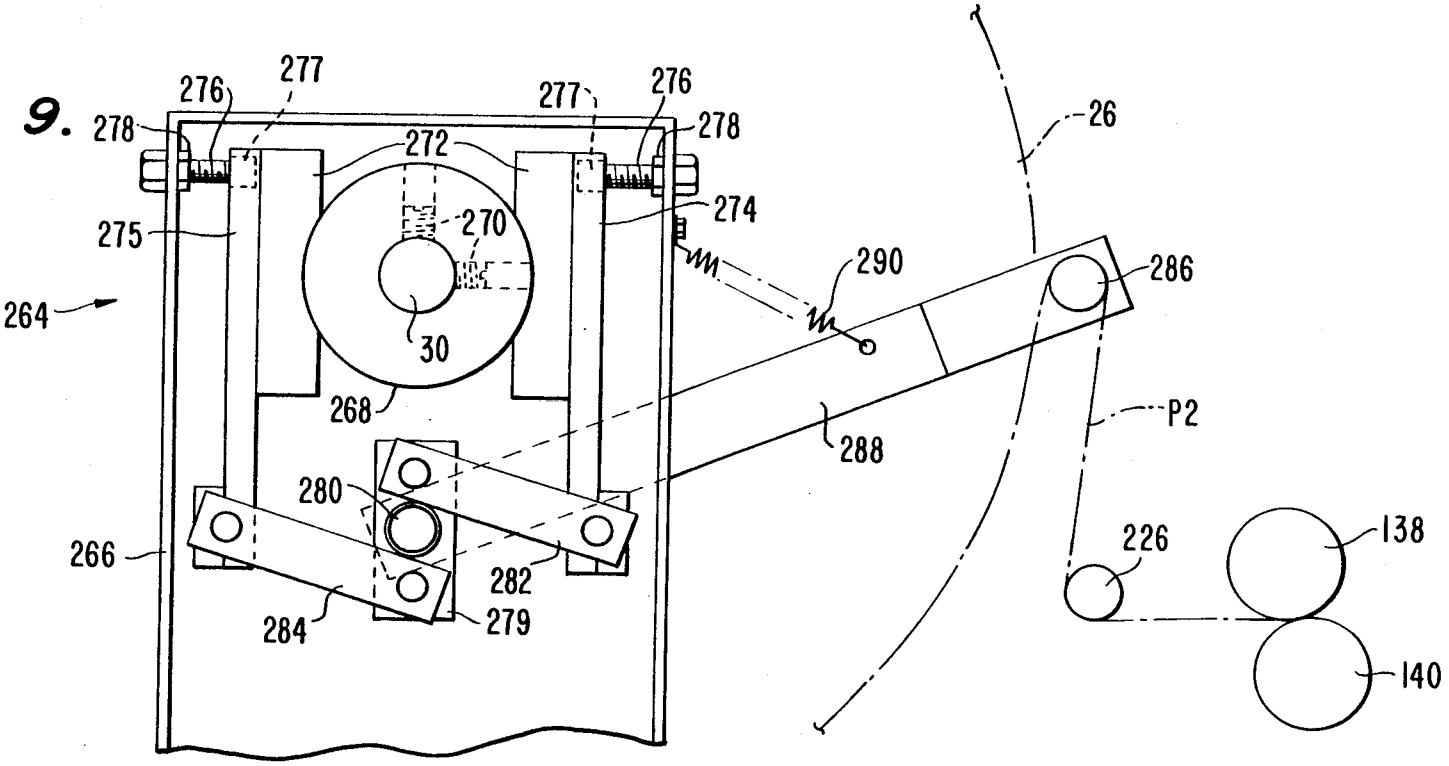
FIG. 9 is a rear elevation of a brake for a paper roll.

As can be seen from FIG. 9, a brake 264 is provided, in a housing 266, for each paper roll spindle 28 and 30 to control its rotation due to the pull exerted on the paper web by the paper conveying rollers. The brake 264 is shown in association with the paper roll 26, although it is understood that a similar brake is provided for the paper roll 24. The brake 264 includes a brake drum 268 fixed on a portion of the spindle 30 by set screws 270. Opposite sides of the brake drum 268 are engageable by a pair of brake pads 272, each brake pad having a concave surface complementary to the surface of the brake drum 268 and each brake pad being mounted on an upright element 274 and 275. Each upright element 274 and 275 is supported in the housing 266 by a bolt 276 secured in an opening in a side wall of the housing 266 from which it extends into a slightly enlarged opening 277 at the back of the upright elements 274 and 275. A lock nut 278 positioned on each bolt 276 inside the housing 266 fixes the bolt 276 in place. A brake block 279 is fixed to a shaft 280 for rotation in the housing 266 below the spindle 30, and a pair of links 282 and 284 are pivotally connected at one end to the brake block 279, the link 282 at a point above the center of rotation of the brake block 279 and the link 284 at a point below the center of rotation. The link 282 is pivotally connected at its other end to the lower end of the inner upright element 274, at a level even with the shaft 280. The lower link 284 is pivotally connected at its other end to a lower end of the outer upright element 275. A take up roller 286 is rotatably mounted at one end of a brake lever 288, between the brake housing 266 and the stationary guide bar 226. The other end of the brake lever 288 is secured to the brake block 279, and the end of the brake lever 288 on which the take up roller 286 is mounted is biased upwardly by a tension spring 290 connected between the brake lever 288 and an upper portion of the brake housing 266.

When the lower paper conveying rollers 138 and 140 pull the web P2 of paper, the force of the paper on the take up roller 286 pulls down the take up roller 286 and the end of the brake lever 288 on which the take up roller 286 is mounted. The brake lever 288 rotates the brake block 279 in a clockwise direction, moving the pivotal connection with the link 282 to the right and the pivotal connection with the link 284 to the left. Thus, the links 282 and 284 act to move the lower ends of the upright elements 274 and 275 away from the brake drum 268, and the upper portions of the upright elements 274 and 275 pivot on the ends of the bolts 276 because of the play between the ends of the bolts 276 and the slightly enlarged openings 277. Therefore, the brake pads 272 move away from the brake drum 268, allowing the spindle 30 and, thus, the paper roll 26 to rotate to feed paper in order to meet the demand of the paper conveying assembly. When the paper conveying assembly 32 slows or stops, the force of the paper on the take up roller 286 is reduced and the spring 290 biases the brake lever 288 upward. This motion causes the brake drum 268 to be clamped between the brake pads 272, thereby slowing or stopping the spindle 30 and paper roll 26. The paper roll brake 264 thus prevents excess lengths of slack from developing in the paper web.

SPINDLE

The adjustable spindles 28 and 30 are identical in structure. Therefore, only the spindle 28 will be described. As can be seen from FIG. 10, the spindle 28 for the paper roll 24 includes a spindle shaft 292 supported at one end in bearings connected to the interleaver frame 11 for supporting the spindle 28 and the paper roll 24 in a cantilevered manner. The free end of the spindle shaft 292 is welded to one end of a spindle sleeve 294 through an interposed bushing or bearing 296 so that the spindle sleeve 294 can rotate with the spindle shaft 292. The paper roll 24 has an internal diameter which is somewhat larger than the outer diameter of the spindle sleeve 294, so that the paper roll 24 is carried loosely by the spindle sleeve. In order to prevent movement of the paper roll 24 with respect to the spindle sleeve 292 in both the circumferential and axial directions, a gripping assembly 298 is provided within the spindle sleeve 292. The gripping assembly 298 includes a plurality of gripping fingers 300 which are pivotable from positions entirely within the spindle sleeve 292 to positions in which portions of the gripping fingers 300 protrude radially beyond the outer surface of the spindle sleeve 292 through openings 302 defined therein. The gripping fingers 300 have sharp portions, such as blades 304, for digging into the paper roll 24 supported on the spindle sleeve 292. Each gripping finger 300 has a shank portion 306 which is pivotally connected by a pin 307 to a first lock element 308 positioned within the spindle sleeve 292 at one end of the gripping assembly 298. A second lock element 310 is proVided Within the spindle sleeve 292 at the opposite end of the gripping assembly 298, the second lock element 310 carrying a plurality of gripping finger supports in the form of links 312 having bifurcations 313. Each bifurcated link 312 is pivotally connected at a stem end 314 by a pin 316 to the second lock element 310 and at an opposite, bifurcated end 318 to one of the gripping fingers 300 at a point adjacent to the blade 304 and remcte from the pivotal connection of the shank portion 306 with the first lock element 308. The bifurcations 313 extend along the opposite sides of each gripping finger 300, the bifurcations 313 and the gripping fingers 300 having aligned apertures through which pins 320 extend. The pins 307 and 316 are positioned in recesses 322 and 324 in the first lock element 308 and the second lock element 310, respectively, the shank portions 306 of the gripping fingers 300 and the stem ends 314 of the bifurcated links 312 extending into the recesses 322 and 324 and including openings for receiving the pins 307 and 316 in pivotal connections.

The first and second lock elements 308 and 310 are mounted for movement toward and away from one another on an operating rod 326 extending axially into the spindle sleeve 294. The operating rod 326 includes a threaded end portion 328 which extends through the first lock element 308 in a bore 330 having internal threads which mate with the threads of the threaded end portion 328. The remainder of the operating rod 326 is unthreaded, including the portion on which the second lock element 310 is mounted. The second lock element 310 includes an unthreaded bore 332 through which the operating rod 310 extends, as well as a coaxial recess 334 in alignment with the unthreaded bore 332. A collar 336 is positioned in the unthreaded bore 332, mounted on the operating rod 326 for rotation therewith by a pin 338 extending through aligned openings in the operating rod 326 and the collar 336. An apertured cover plate 340 is fastened to the second lock element 310 over the coaxial recess 334 by suitable fasteners 342 to capture the collar 336 in the coaxial recess. A hand wheel 344 is secured to the outer end of the operating rod 326 so that the operating rod can be manually rotated.

Figure 10:
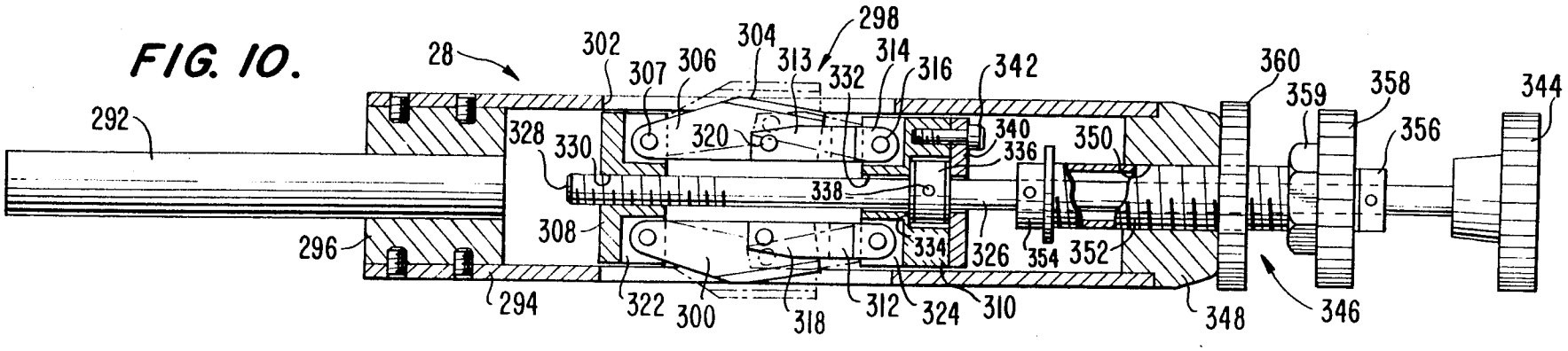
FIG. 10 is a cross section of an adjustable spindle for the paper rolls.

It can be seen from FIG. 10 that rotation of the hand wheel 344 and the operating rod 326 in one direction causes the movement of the first lock element 308 toward the second lock element 310 as a result of the engagement between the threads of the operating rod 326 and the threads in the bore 330 of the first lock element 308. The second lock element 310 remains axially stationary with respect to the operating rod 326 since the collar 336 is fixed to the operating rod 326 and rotates freely within the coaxial recess 334 in the second lock element 310. The movement of the first lock element 308 toward the second lock element 310, in cooperation with the bifurcated links 312, pivots the gripping fingers 300 radially outward into penetrating engagement with the inner surface of the paper roll 24, as can be seen in phantom in FIG. 10.

The operating rod 326 is supported for rotation within the spindle sleeve 294 by an adjusting mechanism 346 for moving or adjusting the entire gripping assembly 298 axially with respect to the spindle 28. The adjusting mechanism 346 includes a nose cone 348 secured at the outer end of the spindle sleeve 294. The nose cone 348 has a threaded axial bore 350 which receives an externally threaded drilled rod 352. The drilled rod 352 is carried by the operating rod 326 for free rotation with respect thereto. However, the drilled rod 352 is prevented from axial movement with respect to the operating rod 326 by collars 354 and 356 which are secured to the operating rod 326 at opposite ends of the drilled rod 352 by aligned bores and pins similar to those used in connection with the collar 336. A hand wheel 358 is threadedly carried on an outer end of the drilled rod 352, and a hand wheel lock nut 359 is provided on the drilled rod 352 in association with the hand wheel 358 for locking the hand wheel in a convenient position along the drilled rod 352. An adjusting lock nut 360 is positioned on the drilled rod 352 adjacent the nose cone 348 so that the drilled rod 352 and, thus, the entire gripping assembly 298 can be locked in a desired axial position.

As can be seen from FIG. 10, manual rotation of the hand wheel 358, locked in position by the hand wheel lock nut 359, causes rotation and axial movement of the threaded drilled rod 352 through the threaded bore 350 of the nose cone 348. The axial movement of the drilled rod 352 is transmitted to the operating rod 326 through the collars 354 and 356. Since the entire gripping assembly 298 moves axially with the operating rod 326, operation of the hand wheel 358 adjusts the axial position of the paper roll 24 on the spindle 28.

A latitude of modification, change and substitution is intended in the foregoing disclosure and in some instances some features of the invention will be employed without a corresponding use of other features. For example, although the interleaver has been discussed in connection with paper, it can also operate with polyethylene film and other sheet materials. Accordingly, it is appropriate that the appended claims be construed broadly and in a manner consistent with the spirit and scope of the invention therein.

I claim:

1. A method of severing sheets of material from a web of said material comprising:

feeding the web of material across an anvil having a hard surface;

crushing the web of material along a line extending across the width of said web by bridging a blade into engagement with the hard surface through the material with a knife edge sufficiently dull that the crushed material of said web tends to stick to said knife edge; and transporting the sheets away from the blade.

2. The method of claim 1 further comprising preventing the material from sticking to the blade by blowing air past the place of engagement between the blade and the hard surface.

3. A method as recited in claim 1, wherein the sheets are transported away from said blade at a greater speed than the web of material is fed across said anvil.

4. A method as recited in claim 1, further comprising acting on said web to prevent said web from being stuck to said knife edge by the crushed material of said web.

5. Apparatus for severing sheets of material from a web of said material comprising:

an anvil having a hard surface;

a blade having a crushing edge engageable with the anvil;

means for supporting the blade for rotation about an axis parallel to the crushing edge such that the crushing edge engages the hard surface of the anvil at one point in its rotation; and means for conveying the web of material to be severed to the point of engagement of the crushing edge with the anvil;

means for transporting the sheets severed from said web away from said point of engagement and from said blade at a greater speed than the conveying conveys the web of material to be severed to said point of engagement;

said edge extending across the entire width of said web at said point of engagement perpendicular to the direction of travel of said web so that said transporting means comprises means to positively separate each sheet from the web by pulling the sheet away from the web when it is severed.

6. The apparatus of claim 5 wherein the crushing edge defines in cross section an angle greater than 5°.

7. The apparatus of claim 5 wherein the crushing edge defines in cross section an angle of approximately 90°.

8. The apparatus of claim 5 further comprising means for preventing the material from adhering to the blade.

9. The apparatus of claim 8 wherein the preventing means comprises means for blowing air past the point of engagement of the crushing edge with the anvil.

10. The apparatus of claim 9 wherein the conveying means includes elongated guide elements for guiding the material to the point of engagement between the crushing edge and the anvil; and the air blowing means includes air passages in said elongated guide elements, said air passages directed toward said point of engagement.

11. The apparatus of claim 5 wherein the material is paper.

12. An apparatus as recited in claim 5, wherein said means for transporting said sheets comprises a means to grip the end of said web with a small enough force to slip on said web until said blade has made crushing engagement with said web, said force being sufficient to separate the resulting sheet from the remainder of said web after said blade has made crushing engagement with said web.

* * * * *